US007140162B2

(12) United States Patent
Baroncini

(10) Patent No.: US 7,140,162 B2
(45) **Date of Patent: *Nov. 28, 2006**

(54) UNIT FOR FEEDING PRODUCTS TO A BLISTERING MACHINE

(75) Inventor: Ivano Baroncini, Osteria Grande (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

This patent is subject to a terminal disclaimer.

(21) Appl. No.: 11/205,823

(22) Filed: Aug. 17, 2005

(65) Prior Publication Data

US 2006/0185754 A1 Aug. 24, 2006

Related U.S. Application Data

(63) Continuation-in-part of application No. 10/488,985, filed as application No. PCT/IB02/03924 on Sep. 24, 2002, now Pat. No. 6,945,012.

(30) Foreign Application Priority Data

Sep. 27, 2001 (IT) ..... BO2001A0594

(51) Int. Cl.
*B65B 1/04* (2006.01)

(52) U.S. Cl. ..... 53/251; 53/247; 53/253; 53/561

(58) Field of Classification Search ..... 53/243, 53/247, 248–251, 475, 559, 550, 253, 453, 53/473, 561; 198/689.1, 867.11, 803.14
See application file for complete search history.

(56) References Cited

U.S. PATENT DOCUMENTS

| | | | | |
|---|---|---|---|---|
| 4,733,520 | A * | 3/1988 | Rabbi | 53/559 |
| 4,845,921 | A * | 7/1989 | Miselli | 53/453 |
| 6,311,743 | B1 * | 11/2001 | Baroncini | 141/234 |
| 6,598,370 | B1 * | 7/2003 | Baroncini | 53/235 |
| 6,945,012 | B1 * | 9/2005 | Baroncini | 53/251 |

* cited by examiner

*Primary Examiner*—Hemant M. Desai
(74) *Attorney, Agent, or Firm*—Willam J Sapone; Coleman Sudol Sapone PC

(57) ABSTRACT

A unit for feeding products (3) to a blistering machine (M) includes a delivery group (2, 2*a*, S) for selectively distributing products (3) to a station (SR), where the products (3) are introduced into respective blisters (40) of a blister band (4), moving in a forward direction (W) inside the blistering machine (M). The filling station (SR) is defined by a conveyor (10) consisting of a belt (11) provided with seas (110). Each seat (110) receives a relative product (3) distributed by the delivery group (2, 2*a*, S) and releases the products (3) into a respective blister (4). The conveyor (10) include at least one endless belt (11), moving in step relation with the blister band (4) wound around respective pulling wheels (13, 14), with an upper portion of the belt (11) defined by an upper run (11*a*) extending under the delivery group (2, 2*a*, S) in a direction parallel to the forward direction (W), defined by a lower run (11*b*) extending, along at least a section (O) parallel to the forward direction (W), substantially very close to and above the blister band (4) and facing the blister band (4).

9 Claims, 3 Drawing Sheets

UNIT FOR FEEDING PRODUCTS TO A BLISTERING MACHINE

CROSS REFERENCE TO RELATED APPLICATIONS

This application is a continuation in part of application Ser. No. 10/488,985, now U.S. Pat. No. 6,945,012 issued on Sep. 20, 2005, which is a national stage of international application PCT/IB02/03924 filed Sep. 24, 2002.

FIELD OF THE INVENTION

The present invention relates to feeding products such as tablets, pills, capsules and the like and their introduction into respective blister of a blister band usually made of plastic material or aluminum, in a blistering machine.

In particular, the present invention is advantageously used in automatic blistering machines to produce blister packs containing tablets, pharmaceutical capsules, to which reference is made in the following description without losing generality.

BACKGROUND OF THE INVENTION

Currently, in an automatic blistering machine, a continuous band of heat-weldable material, or of aluminium, is driven to move forward through different working stations in the following order: a forming station, where receptacles, or blisters, are made in the band, a station, where the products are fed and the blisters are filled with the products, a station, where the upper surface of the band is sealed, and a station, where the pieces of the band containing a predetermined number or blisters, and consequently of products, are cut, each of these pieces forming a blister pack.

A unit is situated at the above feeding and filling station for feeding products and introducing them into the blisters. The above unit assures a correct filling of all the blisters, as well as the integrity of the products, so as to reduce jams and wastes of products, all this while maintaining the required high production speed.

Among different proposed solutions, one particularly advantageous is described in the International Patent Application PCT Num. WO 01/42088 of the same Applicant.

According to this solution, a unit for feeding products to a blister band situated below includes basically selection means which form a plurality of longitudinal channels, arranged in such a way as to define an oscillating grid and aimed at receiving products coming from the hopper situated above.

The selecting means are connected to suitable oscillating means, which generate a relative oscillating movement, crosswise and/or longitudinally, between the selecting means and the blister band opposite thereto, so as to facilitate stable introduction of the products present in the longitudinal channels, falling down into the corresponding blisters formed in the band.

A system of this kind requires overfeeding of products; therefore, in a fixed interval of time, the hopper must feed the selecting means with a number of products exceeding the number of blisters facing the grid in this interval of time.

Then, downstream of the selecting means, the exceeding products, which are not yet introduced into the blisters, are usually conveyed, by suitable collecting means, to the feeding hopper and then re-cycled.

The above described unit is functionally efficient, in particular as regards filling of blisters, which are usually sized as the products they must contain, i.e. the dimensions of the blister are slightly bigger than the dimensions of the product; the difference between the dimensions of the blister and the product facilitates the product introduction, but prevents more products from being introduced into the same blister.

In some cases, an product must be introduced in a blister much bigger than it is necessary in normal situation, i.e. in order not to modify the dies in the blister forming station: in this situation, known devices of the above described type do not manage to prevent two or more products, instead of only one, from entering each blister.

In other cases, blisters filling operation must be performed with bigger care with respect to the unit described in the above mentioned International Patent Application PCT Num. WO 01/42088, or other known devices, in order to protect the products integrity.

This necessity is more frequent with products like tablets, which are rougher and more friable than sugarcoated pills and less sliding with respect thereto, or in situations in which aluminium band is used, less resistant to denting than the band of plastic material.

SUMMARY OF THE INVENTION

The object of the present invention is to propose a product feeding unit, which determines stable introduction of only one product in each corresponding blister, although the dimension of the latter is bigger than the dimension of the product.

Another object of the present invention is to propose a unit for feeding and introducing products into blisters, whose conformation ensures filling of the blisters by an extremely delicate operation, thus protecting the integrity of the products and/or blisters in best way.

A further object of the present invention is to propose a simple unit, which can be easily adapted to different shapes, and time-matched with other means of an automatic blistering machine.

The above mentioned objects are obtained, in accordance with the subject matter of the claims, by a unit for feeding products to a blistering machine, the unit including a delivery group for selectively distributing products to a station, where the products are introduced into respective blisters of a blister band, the band moving in a forward direction inside said blistering machine;

the unit is characterized in that said filling station includes conveyor means consisting of a belt in which seats are made, each of said seats provided for receiving a relative product distributed by the delivery group and for releasing said products into a respective blister;

said conveying means including at least one endless belt, moving in step relation with said blister band and wound around respective pulling wheels, with an upper portion of the endless belt being defined by an upper run extending below the delivery group, and with a lower portion of the endless belt being defined by a lower run extending, along at least a section parallel to said forward direction, substantially above said blister band and facing said blister band.

BRIEF DESCRIPTION OF THE DRAWINGS

The characteristic features of the present invention will be pointed out in the following description of a preferred, but not only embodiment, with reference to the enclosed drawings, in which.

DETAILED DESCRIPTION OF THE PREFERRED EMBODIMENTS

Figure 1:
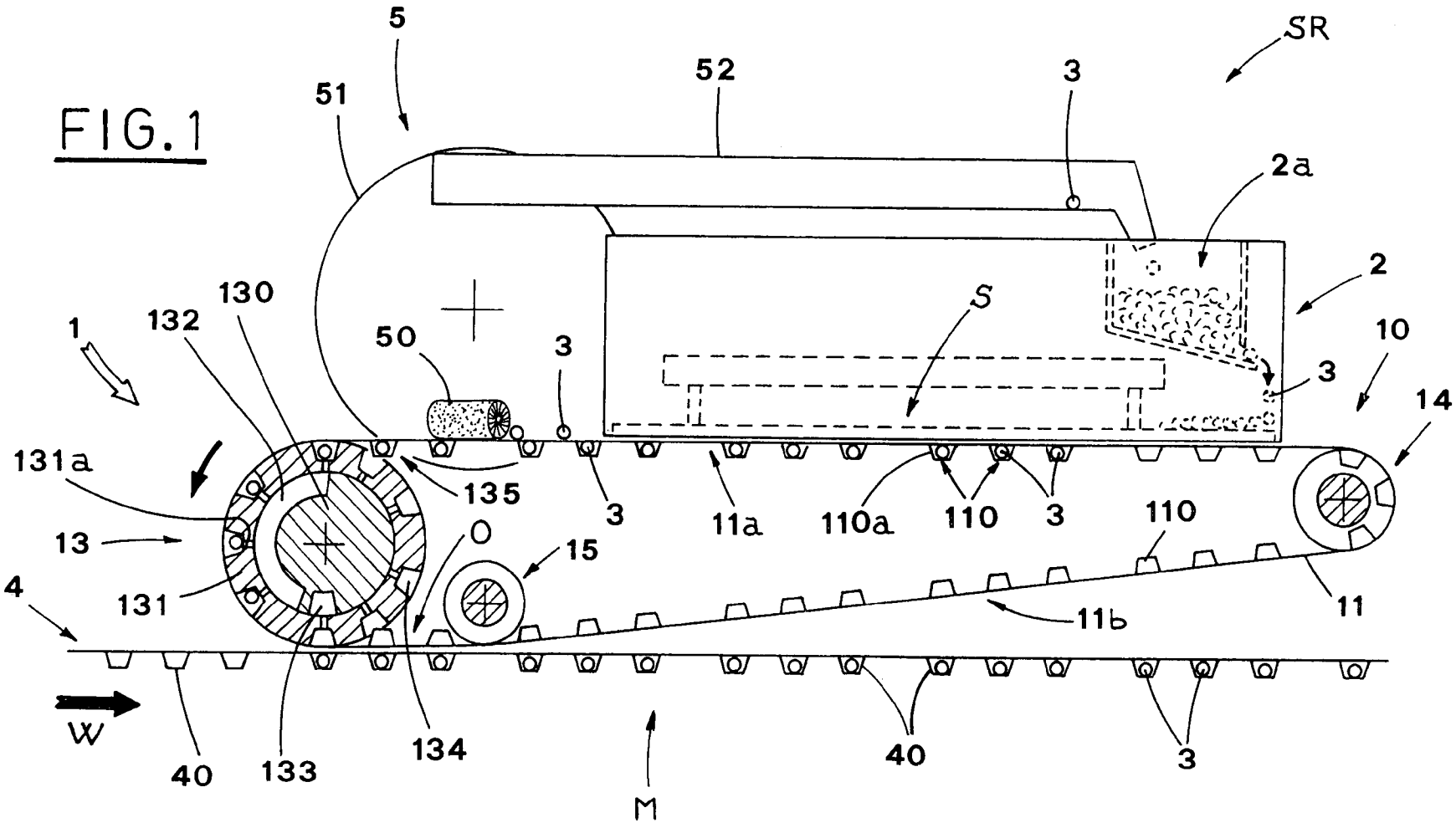
FIG. 1 is a lateral schematic view of a preferred embodiment of the proposed unit.

With reference to FIG. 1, the reference number 1 indicates a unit for feeding products 3, designed to be mounted in correspondence to a filling station SR of a blistering machine M.

The Unit 1 is situated between a group 2 for delivering products 3, e.g. tablets, sugarcoated pills, capsules and the like, and a blister band 4, situated below, in which blisters 40 are formed, and moved forward, preferably continuously, in a horizontal longitudinal direction W.

The distributor group 2 includes a hopper 2*a* (indicated with broken line in FIG. 1), which is aimed at feeding a predetermined quantity of products 3 over means S for selecting the products 3, preferably a vibrating grid (indicated with a broken line in FIG. 1), according to the solution described and illustrated in the above mentioned International Patent Application No. WO 01/42088.

The group 2 is coupled with recycling means 5, of known type, including a brush 50, which intercepts the products 3 in excess over the selecting means S and deviates them onto conveying means of known type, indicated with 51, which convey the exceeding products 3 into a return channel 52, opening into the hopper 2*a*.

According to FIG. 1, the unit 1 includes a conveying member 10, extending endlessly, formed by a belt 11 mounted onto two turn-around wheels 13, 14, the first of which being a driving wheel, and moving the belt 11 counterclockwise, shown with the arrow F in FIG. 1.

The belt 11 defines two substantially horizontal runs of the conveyor 10, upper 11*a* and lower 11*b*, respectively, with the upper run 11*a* situated directly beneath the distributor group 2 and with the lower run 11*b* facing said blister band 4.

Figure 6:
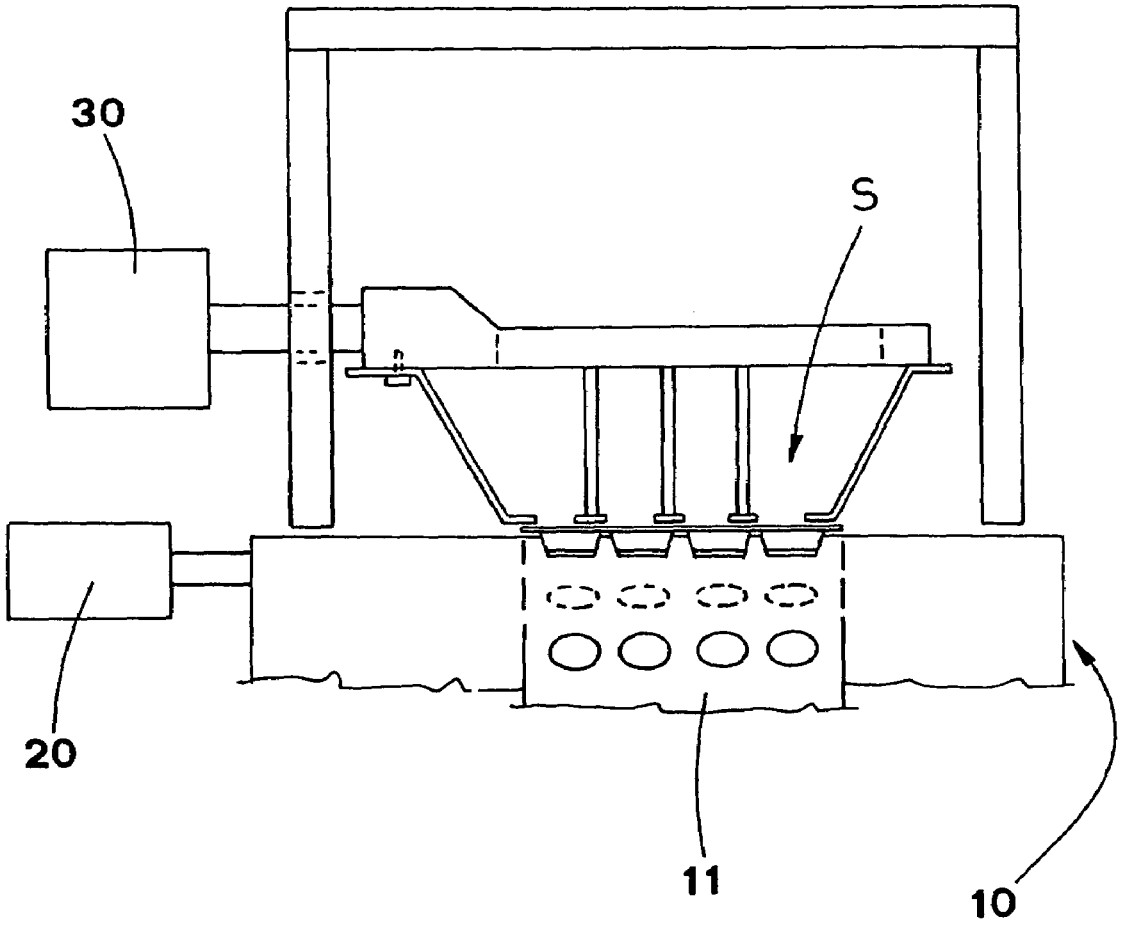
FIG. 6 shows the oscillating means

In analogy with the solution described in the above mentioned International Patent application WO 01/42088 of the same applicant, in which a blister band and a grid are described as being in an oscillating motion relative to each other, the conveying belt 11 and the means S can be set in oscillating movement in relation to each other. In other words, oscillating means 20, 30 (see FIG. 6) are provided coupled to said belt 11 mounted on the wheels 13, 14 and/or to said means S so as to move the belt 11 and the means S with a vibrating motion.

The lower run 11*b* of the belt 11 moves in the same direction as the blister band 4 and in step relation therewith. The lower run 11*b* is so situated to skim the blister band along a substantially horizontal active section 0, parallel to the direction W; to obtain this configuration, a third turn-around wheel 15 is provided, idle on its axis.

The above wheels 13, 14, 15 are adjustable, in known way, to ensure the correct tension of the belt 11 and the position of the abovementioned runs 11*a* and 11*b* with respect to the delivery group 2 and to the blister band 4.

The belt 11 is equipped with a plurality of seats 110 arranged on the belt 11 in a plurality of parallel rows (only one of which is shown in the enclosed figures from 1 to 5 for simplicity's sake), defining a matrix of seats, which are obtained with the same geometric arrangement as the blisters 40 of the belt 4.

The seats 110 are turned toward the outside of the belt 11 and feature, made in the bottom, a through hole 111 (FIGS. 2, 3, and 4), whose function will be explained later on.

The driving wheel 13 is formed by a fixed hub 130, on which a ring-like drum 131 rotates (counterclockwise in FIG. 1 in the direction F).

The ring-like drum is engaged with the belt 11 and connected to motor means, known and shown, which operate the conveying member 10 in time relation with the above blister band 4; consequently, the movement of the lower run 11*b* is in agreement with the direction W of the forward movement of the band 4, and the relative seats 110, in the working section O, are aligned with the corresponding blisters 40.

In order to ensure the correct timing of the belt 11 and to avoids slips, gearing means 135 are provided to obtain the mutual engaging between the ring-like drum 131 and the belt 11.

Figure 2:
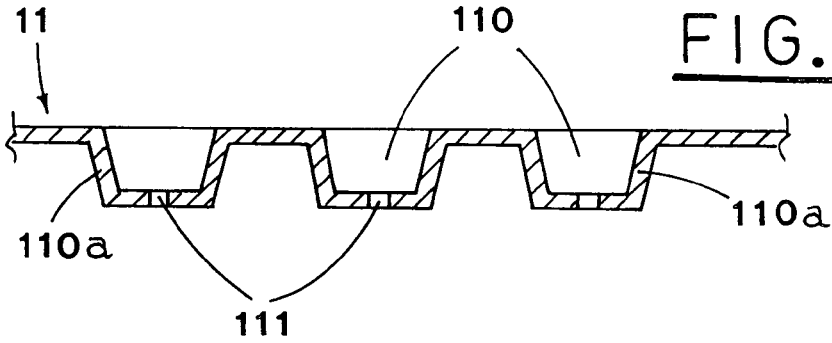

According to a first preferred embodiment, shown in FIGS. 1 and 2, the belt 11 has a section of a constant thickness, with the seats 110, which act as teeth, and by complementary spaces 134 made on the outer circumference of the ring-like drum 131.

Figure 3:
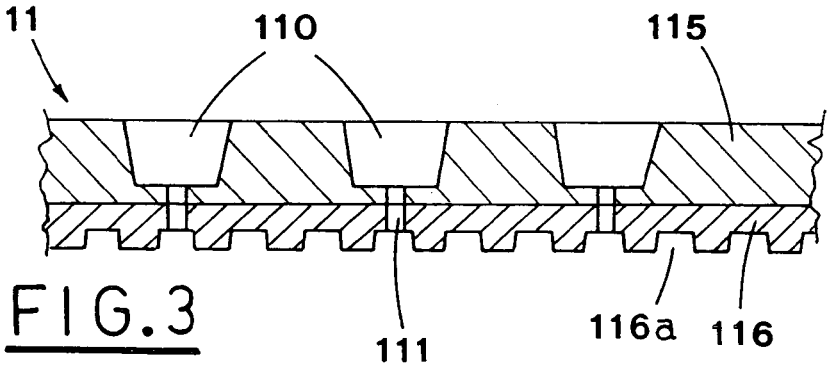
FIGS. 2, 3, 4, 5 are enlarged views of some constructive variants of a particular of the unit shown in FIG. 1.

According to a second embodiment, shown in FIG. 3, the belt 11 includes an outer layer 115, made integral with an inner layer 116, the latter being formed by e.g. toothed belts of known type, featuring teeth 116*a*.

In this case, the teeth 116*a*, together with the complementary spaces (not shown) made on the outer circumference of the ring-like drum 131 define fearing means 135 with the drum 131; the seats 110 are dug in the thickness of the outer layer 115, and the through hole 111 of each seat in made both layers 115, 116.

Figure 4:
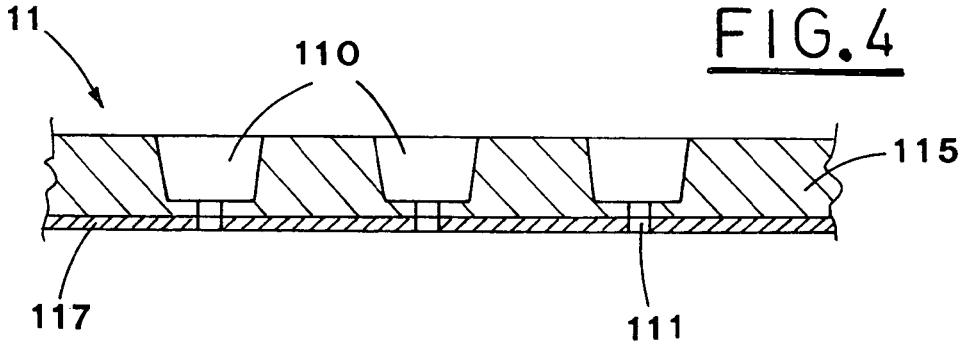
Figure 5:
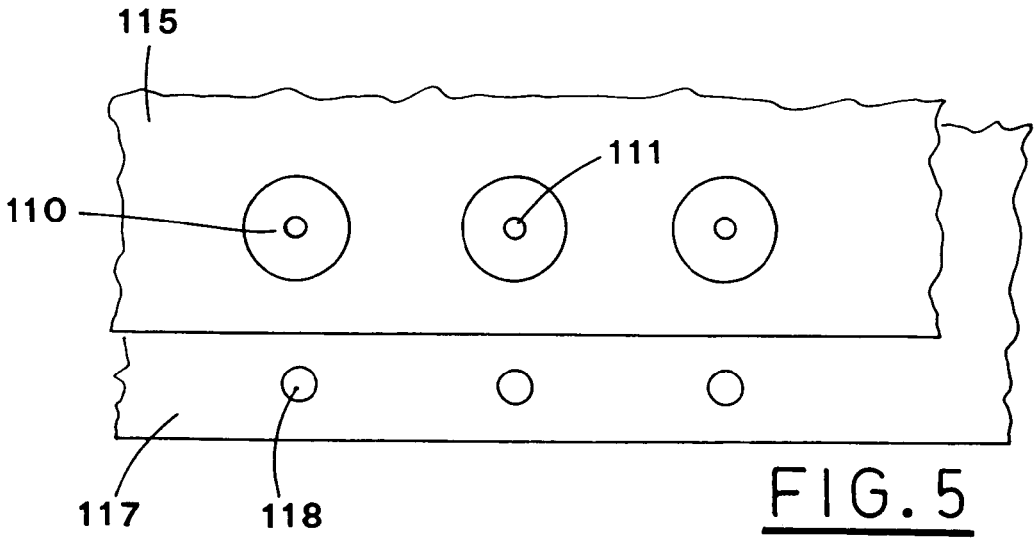

According to a third embodiment, shown in FIGS. 4 and 5, the belt 11 includes an outer layer 115, identical to the one of the second embodiment shown in FIG. 3. The outer layer 115 is made integral with a semi-rigid strip 117, in which holes 118 are made for engagement with corresponding pins (not shown) made radially on the outer circumference of the ring-like drum 131.

According to what is shown in FIG. 1, holding means 132 are connected to the driving wheel 13, to prevent the products 3 from leaving the seats 110 in the semicircular section T of the belt 11, engaged with, and touching, the drum 131 of the wheel 13, the section T being defined between the upper run 11*a* and the lower run 11*b*.

The above mentioned holding means 132 are formed by suction means and include a fist ring-like chamber 132, made in the fixed hub 130 and set in a vacuum condition by suction means, known and now shown, and set in communication with the seats 110 of the corresponding section of the belt 11 by the relative through holed 111, which in turn communicate with the corresponding holes 131*a* made on the ring-like drum 131.

A second chamber 133 is made directly after of the fist chamber 132 on the fixed hub 130 (considering the rotation direction thereof), and has such a width as to engages only one row of seats 110, when the latter is situated in the lower part of the ring-like drum 131 and moves after the first chamber 132 during rotation of the driving wheel 13.

The second chamber 133 is set in communication with blowing means, likewise known and not shown, to define means E for ejecting the products 3, that is to say aimed at delivery jets of compressed air which reach the seats 110, each time involved, through the relative holes 131*a*, 111, so as to expel the products 3 from the seats 110. In this way, the introduction of the products 3, each inside a respective single blister 40 of the blister band 4, is determined and facilitated.

The operation of the unit 1 is described below.

The distributor group 2 feeds the products 3 over the selecting means S, which are situated directly above the upper run 11*b* of the belt 11 to allow the products 3 to be correctly introduced into the seats 110 of the belt 11 situated below.

When the products 3, introduced each one into the relative seats 110, reach the terminal part of the upper rum 11*a*, they move forward along the joining semi-circular section, on the circumference of the ring-like drum 131, held inside the seats 110 by the vacuum effect in the first chamber 132 and acting through the holes 111 and 131*a*.

When the seats 110 reach the lower position under the ring-like drum 131 and at the beginning of the lower rum 11*b*, they face and are aligned with the corresponding blisters 40, situated below, along the above mentioned working section O of the same run; in this step, the products fall delicately into the respective blisters 40, both due to gravity, but first of all due to the push of the jet of compressed air present in the second chamber 133 and acting through the holes 111 and 131*a*.

Therefore, from what described above, also due to the flat arrangement along the section O of the belt 11 deviated by the wheel 15 and facing the blister band 4, each blister 40 will be surely filled stably with only one product 3, also if the dimensions of the blisters 40 are much bigger than the dimension of the products 3, without any subsequent risk that the products 3 leave blisters 40.

This allows to use the same dies for blisters 40 arranged in the blister forming station without changing them each time products 3 of different dimension or shape are to be fed, since it is enough to substitute the belt 11 in order to adjust the blistering machine M.

In order to protect the integrity of the products 3, the belt 11 can also be made of a material whose hardness does not cause scratches, abrasions, tears and fragmentations of the products 3.

The length of the working section O could in some cases coincide with the length of the lower run 11*b* so as to allow maintaining the seats 110 in a facing relation with the corresponding blisters 40 for a relatively long time, so that the expulsion of the products 3 from the seats 110, facilitated in a first moment by the above mentioned jet of air, can be completed due to the gravity in a relatively long time and this with certainty that the deposit into the relative blisters has been done.

It is also to be noted that the just mentioned feature allows a considerable increase of the speed of the blistering machine M, and consequently, of the production rate.

While various embodiments of the present invention have been shown and described, it will be understood by those skilled in the art that various changes or modifictions can be made without varying from the spirit and scope of the invention.

I claim:

1. A unit (1) for feeding products (3) to a blistering machine (M) comprising:

a delivery group (2,2*a*,S) for selectively distributing products (3) to a filling station (SR) where the products are introduced into respective blisters (40) of a blister band (4), the blister band moving in a forward direction (W) inside said blistering machine (M):

said filling station (SR) having conveyor means (10) consisting of at least one endless belt (11) having a plurality of seats (110) therein for receiving the products (3) distributed by the delivery group (2,2*a*,S);

said at least one endless belt (11) moving in step relation with said blister band (4) and being wound around a pair of opposed pulling wheels (13,14), an upper portion of the endless belt being an upper run (11*a*) extending below the delivery group (2,2*a*,S) for receiving said products, and a lower portion of the endless belt being a lower run (11*b*) extending for a least a first portion parallel to said forward direction (W) and above said blister band (4), the lower run disposed in a facing relation to said blister band (4), as the lower run and blister band travel together through said first portion;

said endless belt (11) and said delivery group (2,2*a*,S) being moved with a vibration motion with respect to one another;

said seats (110) on said endless belt (11) having means (132) for holding said products (3) against a bottom of said seats (110) as said endless belt travels around a pulling wheel (13) from said upper run (11*a*) to said lower run (11*b*), said holding means being releasable for releasing said products (3) from said seats into respective blisters (40) when said seats travel around said pulling wheel into a proximity position with respect to said respective blisters;

said seats having holes in the bottom thereof extending through said endless belt, said holding means (132) being suction means (132) in communication with said through holes (111), and thereby with said products in said seats (110), such that said suction means hold said products against the bottom of said seats until the proximity position is reached.

2. The unit according to claim 1 wherein said upper portion extends in a direction parallel to said forward direction (W).

3. The unite according to claim 1 wherein said lower portion is situated very close to said blister band (4).

4. The unit according to claim 1 wherein said pulling wheel (13) includes a fixed hub (13). A ring-like drum (131) rotatable about the fixed hub, said ring-like drum (131) being engaged with said endless belt (11) when said belt is traveling from said upper run (11*a*) to said lower run (11*b*), said ringlike drum having corresponding through holes (131*a*) in communication with the through holes in the seats in the endless belt for communication with a first chamber (132) made in the fixed hub (130), the first chamber being in communication with a suction source.

5. The unit according to claim 4 wherein a second chamber (133) is made on said fixed hub (130), arranged after said first chamber (132), in a direction of rotation of said pulling wheel (13), and being in communication with said through holes (111,131*a*), and thereby with said products in said seats (110), the second chamber being in communication with expelling means (E) for expelling said products in said seats (119) when the proximity position is reached, to facilitate a stable introduction of each of said products (3) into a respective blister (40) of the blister band (4).

6. The unit according to claim 1 wherein said seats (110) are uniformly arranged on said endless belt (11) in a plurality of aligned rows.

7. The unit according to claim 1 wherein said endless belt (11) includes an outer layer (115) made integral with an inner layer (116), said inner layer including a plurality of teeth, said seats (110) made in the outer layer (115).

8. The unit according to claim 1 where in said endless belt (110 includes an outer layer (115), made integral with a semi-rigid strip (117), holes (118) made in said strip, said seats (110) made in the outer layer.

9. The unit according to claim 1 wherein oscillating means provide the vibration motion.

* * * * *